United States Patent [19]

Smith et al.

[11] Patent Number: 4,474,477

[45] Date of Patent: Oct. 2, 1984

[54] MIXING APPARATUS

[75] Inventors: William H. Smith, McMurray; Roy H. Werner, Pittsburgh, both of Pa.

[73] Assignee: Barrett, Haentjens & Co., Hazleton, Pa.

[21] Appl. No.: 507,783

[22] Filed: Jun. 24, 1983

[51] Int. Cl.[3] ..... B01F 5/00

[52] U.S. Cl. ..... 366/165; 366/167; 366/178

[58] Field of Search ..... 366/165, 167, 172, 177, 366/173, 176, 178, 336, 340, 101, 5, 11; 137/896, 897, 889

[56] References Cited

U.S. PATENT DOCUMENTS

| | | | |
|---|---|---|---|
| 1,826,776 | 10/1931 | Gunther . | |
| 1,848,122 | 3/1932 | Forster . | |
| 2,516,684 | 7/1950 | Doull et al. | 259/151 |
| 2,543,517 | 2/1951 | Anderson | 91/44 |
| 2,653,801 | 9/1953 | Fontein | 366/165 |
| 3,332,442 | 7/1967 | Reed | 137/604 |
| 3,669,417 | 6/1972 | Cornwell | 259/147 |
| 4,053,142 | 10/1977 | Johannes | 366/165 |
| 4,123,800 | 10/1978 | Mazzei | 366/165 |
| 4,344,752 | 8/1982 | Gallagher | 137/896 |

*Primary Examiner*—Robert W. Jenkins

*Attorney, Agent, or Firm*—Webb, Burden, Robinson & Webb

[57] ABSTRACT

Mixing apparatus having an elongated cylindrical mixing chamber with an inlet end and an outlet end and an elongated closed jacket surrounding and spaced from the mixing chamber. The jacket is divided into a number of annular chambers each of which is in communication with the mixing chamber through a ring of inlet passages extending through the wall of the mixing chamber. Each inlet passage in each ring of inlet passages is at an angle toward the outlet end of the mixing chamber and is angularly skewed relative to the axis of the mixing chamber. A throat nozzle is located at the inlet end of the mixing chamber to supply material to the mixing chamber.

13 Claims, 10 Drawing Figures

MIXING APPARATUS

BACKGROUND OF THE INVENTION

1. Field of the Invention

The invention is directed generally to apparatus for mixing a plurality of materials such as a liquid with a liquid, with a gas, with a dry granular or powder material, with solids in a slurry or a suspension or with combinations of these materials. In one embodiment, the mixing apparatus is constructed in a manner to aspirate ambient air into the mixing chamber. More specifically, the invention is directed to mixing apparatus having an elongated cylindrical mixing chamber with a plurality of inlet passages permitting the intimate mixing of gases, liquids and solids and combinations thereof.

2. Description of the Prior Art

Mixers may be broadly classified as batch type or continuous type. In a batch mixer, two or more materials are placed in a container and mechanically mixed by stirring, rotation or tumbling. In continuous mixers, two or more materials are supplied at uniform flow rates into a mixing chamber and are mixed by their velocity and turbulence or by mechanical stirring. Mechanical mixing does not provide sufficient contact between all of the individual molecules of the materials to effect complete mixing or reaction. If the object of the mixing is a reaction, mechanical mixing is wasteful since excess reagents necessary for the reaction must be added in an attempt to achieve as much contact as possible. Thus, the mixing is inefficient.

SUMMARY OF THE INVENTION

The invention is a continuous mixing apparatus having an axial throat nozzle discharging a fluid, a dry material in powder, gas or granular form or a slurry substantially along the longitudinal axis of a generally cylindrical elongated mixing chamber. A fluid or a plurality of different fluids are discharged under pressure into the mixing chamber through a plurality of inlet passages arranged in spaced rings around the circumference of the mixing chamber. The inlet passages in adjacent rings may be staggered, and each inlet passage is directed toward the end of the mixing chamber opposite the throat nozzle. Additionally, each inlet passage is skewed at an angle relative to the axis of the mixing chamber. Because the inlet passages are angled toward the end of the mixing chamber opposite the throat nozzle, the fluid injected through the inlet passages will flow only in the direction of flow of the material entering the mixing chamber through the throat nozzle which eliminates backwashing into the nozzle. Since the inlet passages are skewed, the fluid or fluids discharged therefrom swirl in the form of a helix and intimately mix with the material traveling through the mixing chamber from the throat nozzle to create an intimate and efficient mixing of the material in the mixing chamber. Also, the forwardly directed inlet passages create a venturi effect within the mixing chamber which in turn creates a low pressure area allowing material to flow from the throat nozzle into the mixing chamber and to aspirate air into the mixing chamber through openings in the inlet end of the mixing chamber.

The mixing apparatus may be used for numerous mixing applications such as, for example, the addition of chemicals to waste materials such as acidic mine water, sewage and the like to adjust the chemistry of the waste materials. When treating acidic mine water or sewage, the mixing apparatus of the invention eliminates the need for bulk tank mixing, chemical reaction vessels and diffused aeration basins. Efficient treatment of waste materials is accomplished because the chemicals supplied to the waste materials mix and react with the waste materials in the high energy mixing area of the mixing chamber. Additionally, air may be used to atomize the waste materials to create small globules which will enhance the reaction of the chemicals with the substances in the waste materials.

DESCRIPTION OF THE PREFERRED EMBODIMENTS

Figure 1:
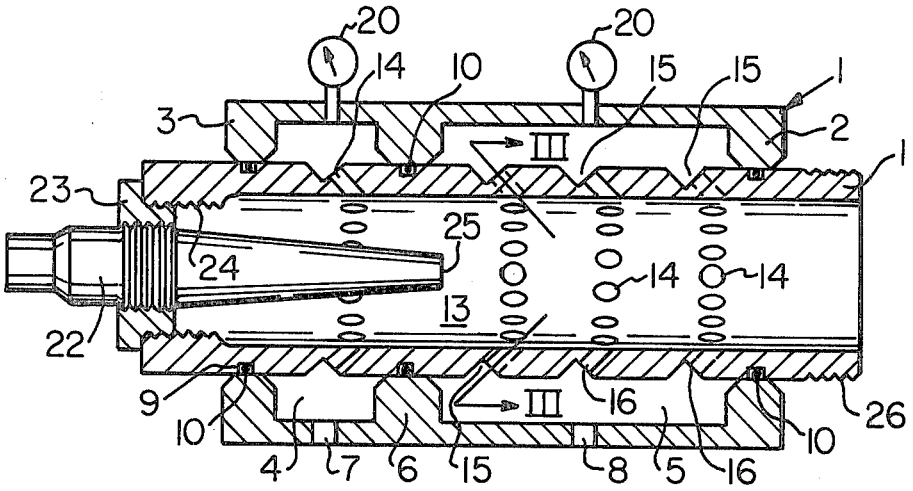
FIG. 1 is an axial section through a first embodiment of a mixing apparatus according to the invention.

In the following description of the drawings, like reference numerals refer to like parts in the different embodiments.

Figure 2:
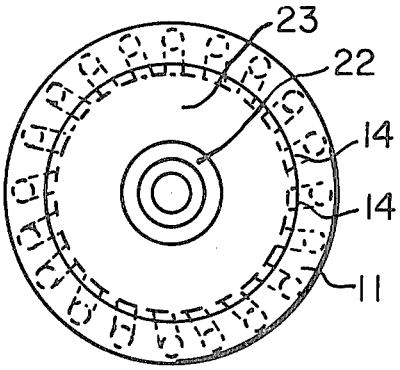
FIG. 2 is an end view of the entry end of the mixing chamber of the apparatus shown in FIGS. 1 and 4.
Figure 3:
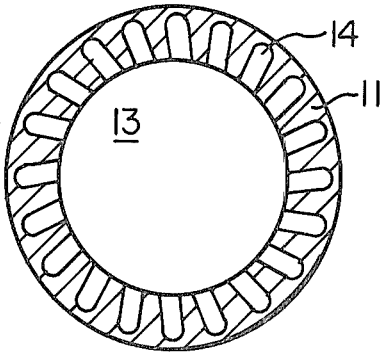
FIG. 3 is a section of line III—III of FIGS. 1, and 4–6.

With reference to FIGS. 1–3 of the drawings, the mixing apparatus includes an outer cylindrical jacket 1 having an annular forward wall 2 and an annular rear wall 3. An annular intermediate wall 6 divides the interior of the jacket into a first annular chamber 4 and a second annular chamber 5. Chamber 4 is in communication with a source of pressurized fluid through an inlet opening 7, and chamber 5 is in communication with a source of pressurized fluid through an inlet opening 8. Both chambers 4 and 5 have standard pressure gauges 20 connected thereto. As will be seen in FIG. 1 of the drawings, each annular wall 2, 3 and 6 is formed with an annular groove 9 in its inner end, and each groove 9 carries a standard O-ring seal 10 to prevent fluid from escaping from chambers 4 and 5. While the jacket 1 is shown with a cylindrical exterior, it will be understood that the exterior of the jacket need not be cylindrical so long as the interior is cylindrical.

The jacket 1 surrounds the exterior of the wall 11 of mixing chamber 13 along a substantial portion of its length, and a plurality of inlet passages 14 extend between the first annular chamber 4 and mixing chamber 13. As shown in the drawings, the inlet passages 14 are located in a plurality of spaced rings extending completely around the circumference of the cylindrical mixing chamber, and the inlet passages in each ring are radially staggered relative to the inlet passages in each adjacent ring. Each inlet passage 14 is at an angle of approximately 25° relative to the longitudinal axis of mixing chamber 13 and is skewed from the axis of the mixing chamber as shown in FIGS. 2 and 3 so that the fluid discharged from inlet passages 14 has a component of motion in the downstream direction and a component of motion with a swirling helical direction. As will be seen in FIGS. 1, 4–6 and 8–10 of the drawings, the exterior surface of mixing chamber wall 11 is formed with a 90° annular notch 15 at the inlet ends of the inlet passages 14 in each ring of inlet passages. Each inlet passage extends between the downstream face 16 of an annular notch 15 and the interior surface of mixing chamber 13. The inlet end of each passage 14 may be formed with a slight chamfer as shown in FIG. 10 of the drawings in order to improve the flow of fluid passing through the inlet passages.

While one ring of inlet passages 14 connects chamber 4 with mixing chamber 13 and three rings of inlet passages 14 connect chamber 5 with mixing chamber 13 in the embodiment shown in FIG. 1 of the drawings, it will be understood by those skilled in the art that the number of rings of inlet passages is not critical and will be determined by such variables as the volume of the mixing chamber, the flow rate of the fluids supplied to the mixing chamber, the type of fluids supplied to the mixing chamber and the material supplied to the mixing chamber through throat nozzle 22. Throat nozzle 22 is threaded into an annular insert 23 which is threaded into the inlet end of the mixing chamber on internal threads 24 formed on the end of mixing chamber wall 11. The throat nozzle 22 is a standard nozzle with an axial throat having a smooth interior wall and decreasing in diameter toward nozzle outlet 25. The specific design of the throat nozzle forms no part of the present invention, and nozzles having different designs may be used to supply material to mixing chamber 13. The mixing chamber wall 11 may be provided with external threads 26 at the discharge end of the mixing chamber for connection to a conduit.

Figure 4:
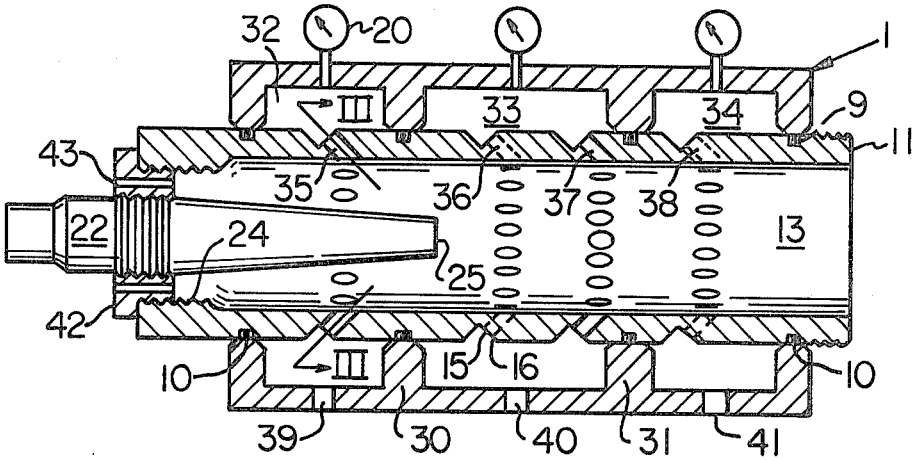
FIG. 4 is an axial section through a second embodiment of a mixing apparatus according to the invention.

The embodiment shown in FIG. 4 of the drawings is similar to the embodiment shown in FIG. 1 of the drawings except that in the embodiment of FIG. 4, the outer cylindrical jacket 1 has a pair of annular intermediate walls 30 and 31 which divide the jacket interior into three annular chambers 32, 33 and 34. Annular chamber 32 communicates with mixing chamber 13 through a single ring of inlet passages 35, annular chamber 33 communicates with mixing chamber 13 through two rings of inlet passages 36 and 37; and annular chamber 34 communicates with mixing chamber 13 through a single ring of inlet passages 38. The exterior of mixing chamber wall 11 is formed with annular right angle notches 15 as in the embodiment shown in FIG. 1, and each inlet passage 35, 36, 37 and 38 has its outer end located on the downstream face 16 of a right angle notch 15. Chambers 32, 33 and 34 are respectively provided with inlet openings 39, 40 and 41 and with standard pressure gauges 20.

In the embodiment shown in FIG. 4 of the drawings, annular insert 42 is threaded into the end of mixing chamber wall 11 and supports throat nozzle 22 in the same manner as insert 23 in FIG. 1. Insert 42 is formed with a plurality of elongated longitudinal radially spaced passages 43 surrounding the throat nozzle. Longitudinal passages 43 permit outside air to be aspirated into the inlet end of mixing chamber 13 by the pressure of the material supplied to mixing chamber 13 through nozzle 22 and the fluid supplied through inlet passages 35, 36, 37 and 38.

Figure 5:
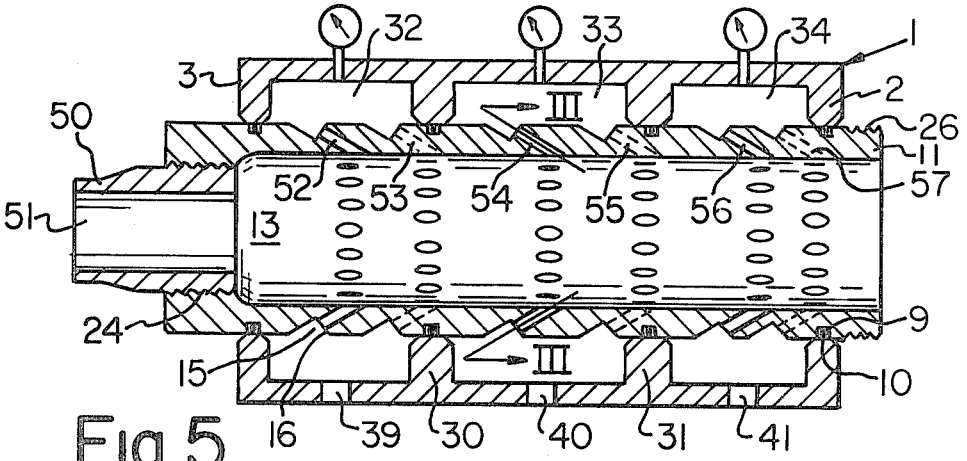
FIG. 5 is an axial section through a third embodiment of a mixing apparatus according to the invention.

The embodiment shown in FIG. 5 of the drawings is similar to the embodiment shown in FIG. 4 in that the interior of outer jacket 1 is divided into three annular chambers 32, 33 and 34. However, the embodiment shown in FIG. 5 has a throat nozzle 50 with a straight inlet throat 51. Throat nozzle 50 has external threads received by internal threads 24 on the end of mixing chamber wall 11. Throat nozzle 50 is designed to supply a slurry or a pulp material to mixing chamber 13. In addition to having a different throat nozzle than the embodiment shown in FIGS. 1 and 4 of the drawings, the embodiment shown in FIG. 5 of the drawings has two rings of inlet passages connecting each annular chamber 32, 33 and 34 with the mixing chamber. In the embodiment shown in FIG. 4 of the drawings, only the center annular chamber 33 is connected with mixing chamber 13 by two rings of inlet passages. The inlet passages in FIG. 5 are indicated by reference numerals 52, 53, 54, 55, 56 and 57.

Figure 6:
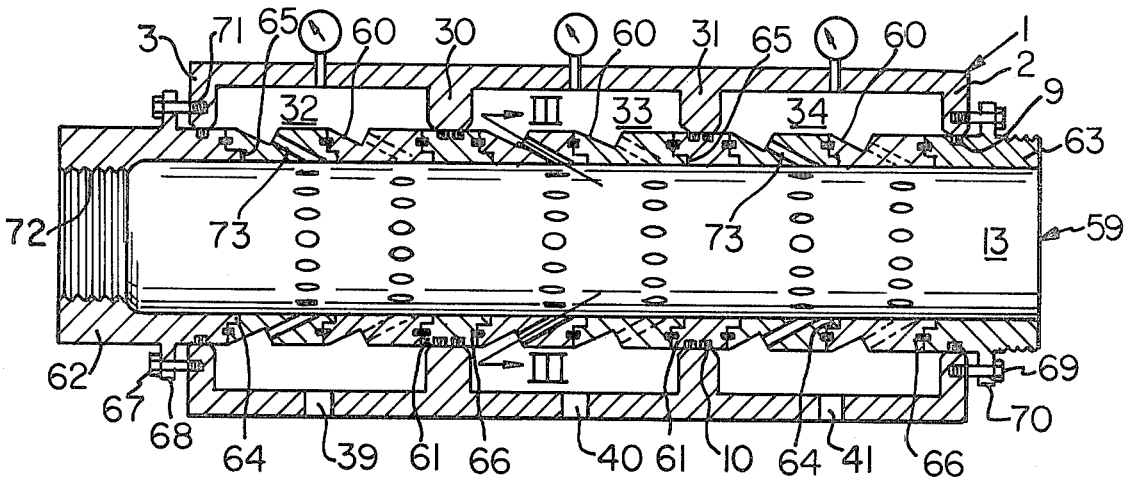
FIG. 6 is an axial section through a fourth embodiment of a mixing apparatus according to the invention.

The embodiment shown in FIG. 6 of the drawings is similar to the embodiment shown in FIG. 5 in that it has a pair of rings of inlet passages connecting each chamber 32, 33 and 34 formed by outer jacket 1 with mixing chamber 13. However, in the embodiment shown in FIG. 6 of the drawings, the mixing chamber wall 59 is formed by a plurality of abutting individual annular inserts. Each ring of inlet passages is formed in an annular supply insert 60. Mixing chamber wall 59 also includes annular spacer inserts 61, an annular inlet insert 62 and an annular outlet insert 63. The supply inserts with the inlet passages formed therein as well as spacer inserts 61, inlet insert 62 and outlet insert 63 are fitted together by means of an annular extension 64 formed on the downstream end of one insert and an annular step portion 65 formed in the upstream end of each adjacent insert and spaced alignment pins 66 which extend between the abutting ends of adjacent inserts. By using inserts as shown in the embodiment of FIG. 6, it is possible to form mixing chambers of various lengths having a wall with different arrangements of the number and design of the rings of inlet passages connecting the annular chambers formed by outer jacket 1 with mixing chamber 13.

The inserts are tightly held together to form mixing chamber wall 59 by a plurality of radially spaced bolts 67 which freely pass through holes in an annular lug ring 68 on the exterior surface of inlet insert 62 and a plurality of radially spaced bolts 69 which freely pass through holes in an annular lug ring 70 on the exterior surface of outlet insert 63. Each bolt 67 and 69 threadedly engages a threaded hole 71 in the forward and rear walls 2 and 3 of outer jacket 1. As the bolts are tightened, they will pull the inlet and outlet inserts 62 and 63 of mixing chamber wall 59 toward one another and hold the supply inserts 60 and spacer inserts 61 together. The embodiment shown in FIG. 6 is shown without a throat nozzle at the inlet end of mixing chamber 13, but it will be readily apparent to one skilled in that any desired throat nozzle may be threaded onto the internal threads 72 formed on inlet insert 62 of the mixing chamber wall. The inlet passages in each supply insert 60 are designated 73.

Figure 7:
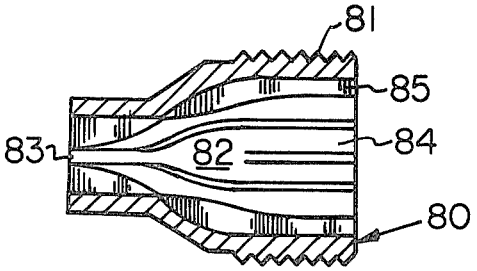
FIG. 7 is an axial section through a stirring device for use in the mixing apparatus of the invention.

FIG. 7 of the drawings shows a stirring device 80 which may be threadedly attached at the inlet end of a mixing chamber wall by external threads 81 which cooperate with the internal threads on the inlet end of the mixing chamber wall. The interior 82 of stirring device 80 expands from the inlet section 83 which will be attached to a material supply conduit to an enlarged outlet section 84 which discharges into a mixing chamber. The interior surface of the wall of stirring device 80 is provided with a plurality of spaced helical-shaped vanes 85 for imparting a swirling motion to the material passing through stirring device 80 into the mixing chamber. The device shown in FIG. 7 may be advantageously used to supply a pulp material to a mixing chamber although it is not limited to such use.

Figure 8:
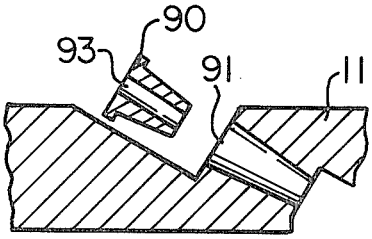
FIG. 8 is a partial axial section through the mixing chamber wall showing a tapered inlet passage insert.

FIG. 8 of the drawings shows a tapered inlet passage insert 90 for use in a tapered inlet passage 91 connecting a chamber formed by the interior of outer jacket 1 with the mixing chamber 13. Insert 90 has a frustoconical outer shape and inlet passage 91 has a corresponding frustoconical shape so that the insert may be easily inserted into an inlet passage and will remain in place. The insert 90 has a flow passage 93 therethrough which changes the effective diameter of the inlet passage and decreases the flow of a fluid passing into the mixing chamber.

Figure 9:
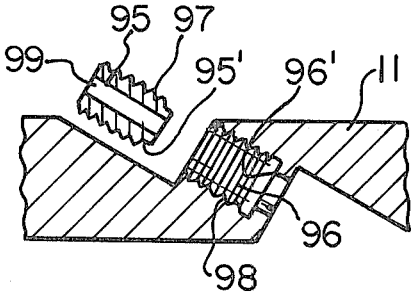
FIG. 9 is a partial axial section through the mixing chamber wall showing a threaded inlet passage insert.
Figure 10:
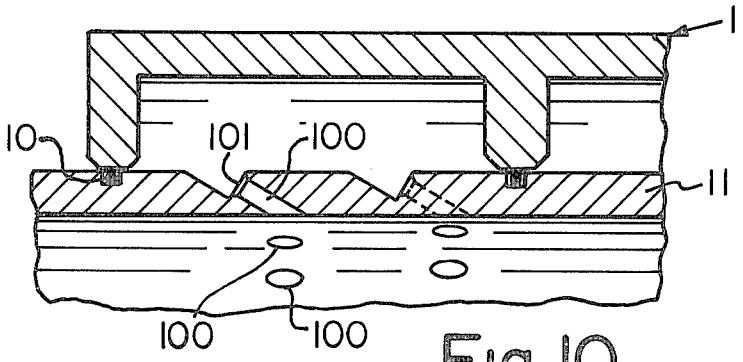
FIG. 10 is a partial axial section through the mixing apparatus showing inlet passages having a chamfered entrance end.

FIG. 9 of the drawings shows a variation of the embodiment shown in FIG. 8 of the drawings wherein an externally threaded insert 95 is threaded into an internally threaded inlet passage 96 to change the effective diameter of the inlet passage and thereby decrease the flow of a fluid passing into the mixing chamber. Insert 95 has external threads 97 which cooperate with internal threads 98 on passage 96 to hold the insert in the passage. An inwardly extending shoulder 96' is formed on the inner end of inlet passage 96 which cooperates with a shoulder 95' on the inner end of insert 95 to prevent the insert from being threaded past the end of passage 96. Insert 95 has a flow passage 99 extending therethrough.

The inserts shown in FIGS. 8 and 9 of the drawings make it possible to adapt a mixing chamber to different uses by changing the effective diameter of the inlet passages through which materials flow into the mixing chamber.

FIG. 10 of the drawings shows an embodiment of the invention wherein the entrance end of each inlet passage 100 is chamfered as at 101 in order to improve the flow of the fluid passing therethrough. This chamfered end 101 of each passage 100 may be important when a fluid is flowing into the mixing chamber through the passages.

In operation, a fluid under pressure is supplied through an inlet port to each annular chamber formed by the interior of outer jacket 1. The fluid passes through the inlet passages in one or more rings into the mixing chamber. Due to the angled and skewed arrangement of the inlet passages, the fluid passing into the mixing chamber will have a component of helical swirling motion as well as a component of downstream motion. This motion creates a venturi effect which tends to create a low pressure area in the mixing chamber which will assist in drawing material from a throat nozzle at the inlet end of the mixing chamber and through the longitudinal axial passages in the insert in the embodiment of FIG. 4. The material passing through the throat nozzle may be a liquid, a gas, or a solid or a combination thereof. The movement of the fluid entering the mixing chamber through the inlet passages will cause the material from the throat nozzle to break up and to intimately contact the fluid in the mixing chamber. The mixing apparatus could be used as a substitute for a froth cell by supplying water with fine solids therein through the throat nozzle and mixing the water and fine solids with high pressure air and a chemical supplied through the inlet passages.

While preferred embodiments of the invention have been described herein, it is to be understood that the invention may be embodied within the scope of the appended claims.

We claim:

1. Mixing apparatus including an elongated cylindrical mixing chamber having a wall with an inlet end and an outlet end, an elongated outer jacket surrounding said mixing chamber wall, the interior of said jacket being cylindrical and spaced from the exterior of said mixing chamber wall, the interior of said jacket being coaxial with said mixing chamber and having a first annular end member contacting the exterior of said mixing chamber wall and a second annular end member contacting the exterior of said mixing chamber wall, at least one intermediate annular wall on the interior of said jacket contacting the exterior of said mixing chamber wall to divide the space between the exterior of said mixing chamber wall and the interior of said jacket into a plurality of annular chambers, a plurality of rings of inlet passages extending through said mixing chamber wall to connect said annular chambers and the interior of said mixing chamber, each inlet passage in each of said rings of inlet passages extending at an angle toward said outlet end of said mixing chamber wall and being angularly skewed relative to the longitudinal axis of said mixing chamber, whereby fluids passing through said inlet passages have a component of motion toward said outlet end of said mixing chamber wall and a rotary component of motion relative to the radius of said mixing chamber.

2. Mixing apparatus as set forth in claim 1 including a throat nozzle in said inlet end of said mixing chamber for supplying material to the interior of said mixing chamber.

3. Mixing apparatus as set forth in claim 1 wherein at least one ring of inlet passages extends between each of said annular chambers and the interior of said mixing chamber.

4. Mixing apparatus as set forth in claim 1 including an annular insert at the inlet end of said mixing chamber threadedly connected to the wall of said mixing chamber, a throat nozzle supported in said annular insert and a plurality of elongated radially spaced passages extending through said insert.

5. Mixing apparatus as set forth in claim 1 wherein two rings of inlet passages extend between each of said annular chambers and the interior of said mixing chamber.

6. Mixing apparatus as set forth in claim 1 wherein the discharge ends of said inlet passages are staggered in each adjacent ring of said inlet passages.

7. Mixing apparatus as set forth in claim 1 wherein said mixing chamber wall consists of a plurality of individual annular inserts, said inserts including an inlet end insert forming the inlet end of said mixing chamber wall and an outlet end insert forming the outlet end of said mixing chamber wall, a plurality of supply inserts between said inlet end insert and said outlet end insert and spacer inserts between supply inserts, each of said supply inserts having a ring of inlet passages extending between an annular chamber formed by the interior of said jacket and the interior of said mixing chamber, said inlet end insert and said outlet end insert being attached to the end members of said jacket to retain said supply inserts and said spacer inserts in position to form said mixing chamber wall.

8. Apparatus as set forth in claim 7 wherein each of said annular inserts is formed with an annular extension on the downstream end and an annular step portion in the upstream end, whereby said annular extension of each insert fits within said annular step portion in each adjacent insert and at least one pin extending longitudinally between adjacent inserts to position said inserts.

9. Mixing apparatus as set forth in claim 1 including a stirring device at the inlet end of said mixing chamber wall, said stirring device having an inlet section with a decreased diameter relative to the diameter of the outlet section and helical vanes attached to the inner surface of said stirring device to impart a swirling motion to material passing through said stirring device into said mixing chamber.

10. Mixing apparatus as set forth in claim 1 wherein each of said inlet passages is chamfered at the entrance rod.

11. Mixing apparatus as set forth in claim 1 wherein each of said inlet passages is tapered from a large entrance end to a smaller discharge end and a frustoconical insert is fitted within each of said inlet passages, said frustoconical insert having a flow passage extending completely therethrough, whereby the diameter of each of said inlet passages is decreased.

12. Mixing apparatus as set forth in claim 1 wherein each of said inlet passages is internally threaded through a substantial portion of its length and an externally threaded sleeve is threaded into each of said inlet passages, said externally threaded sleeve having a flow passage extending completely therethrough, whereby the diameter of each of said inlet passages is decreased.

13. Apparatus as set forth in claim 12 including an internal shoulder in each of said inlet passages adjacent to the discharge end thereof and an external shoulder adjacent an end of each of said threaded sleeves, whereby contact between said shoulders prevents said threaded sleeves from extending into the interior of said mixing chamber.

* * * * *

UNITED STATES PATENT AND TRADEMARK OFFICE

CERTIFICATE OF CORRECTION

PATENT NO. : 4,474,477

DATED : October 2, 1984

INVENTOR(S) : William H. Smith et al.

It is certified that error appears in the above-identified patent and that said Letters Patent is hereby corrected as shown below:

Column 4 Line 61 After "in" insert —the art—.

Claim 10 - Column 7 Line 22 "rod" should read —end—.

Signed and Sealed this

*Nineteenth* Day of *February 1985*

[SEAL]

*Attest:*

DONALD J. QUIGG

*Attesting Officer* *Acting Commissioner of Patents and Trademarks*